US007096839B2

(12) United States Patent
Nakazawa et al.

(10) Patent No.: US 7,096,839 B2
(45) Date of Patent: Aug. 29, 2006

(54) GROUND STRUCTURE FOR A VEHICLE

(75) Inventors: Yoshihiro Nakazawa, Saitama (JP); Toshiki Ogawa, Saitama (JP); Toru Miyagawa, Saitama (JP); Shinichi Maeda, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/617,049

(22) Filed: Jul. 11, 2003

(65) Prior Publication Data

US 2004/0079311 A1 Apr. 29, 2004

(30) Foreign Application Priority Data

Jul. 15, 2002 (JP) ..... 2002-206023
Apr. 16, 2003 (JP) ..... 2003-111502

(51) Int. Cl.
*F02N 11/08* (2006.01)

(52) U.S. Cl. ..... 123/179.1; 307/9.1

(58) Field of Classification Search ..... 123/179.1; 307/9.1, 10.6; 290/38 R
See application file for complete search history.

(56) References Cited

U.S. PATENT DOCUMENTS 4,074,670 A * 2/1978 Roberts et al. ..... 123/538
4,158,346 A * 6/1979 Roberts et al. ..... 123/1 R
2005/0166882 A1* 8/2005 Suzuki et al. ..... 123/143 C

FOREIGN PATENT DOCUMENTS

JP 2001-253308 A 9/2001
JP WO 03/091074 A1 * 6/2003

OTHER PUBLICATIONS

Article from Car Audio Web Site, "Grounding your Way To More Horsepower" Casey Thorson, 4 pgs.*

* cited by examiner

*Primary Examiner*—Carl S. Miller
*Assistant Examiner*—Arnold Castro
(74) *Attorney, Agent, or Firm*—Birch, Stewart Kolasch & Birch, LLP

(57) ABSTRACT

A ground cable between an engine and a body frame has an advantage against vibrations and for increasing the universality in use and further improve the flexibility in coupling to a vehicle body. An engine case and a vehicle body frame are connected to each other by a cable to ground the engine. The cable has a diameter set substantially equal to one of the other cables that has the greatest wire diameter wiring lines, that is, a wiring line cable between a battery and the engine and wiring line cables and between the battery and a starter motor.

19 Claims, 4 Drawing Sheets

FIG. 4

BATTERY CAPACITY

| | 4Ah | 7Ah | 9Ah | 12Ah | ≧14Ah |
|---|---|---|---|---|---|
| A V$mm^2$ | 3 | 5 | 8 | 9～15 | 15 |

SECTIONAL AREA

GROUND STRUCTURE FOR A VEHICLE

CROSS-REFERENCE TO RELATED APPLICATIONS

The present application claims priority under 35 USC 119 to Japanese Patent Application Nos. 2002-206023 filed on Jul. 15, 2002 and 2003-111502 filed on Apr. 16, 2003 the entire contents thereof are hereby incorporated by reference.

BACKGROUND OF THE INVENTION

1. Field of the Invention

This invention relates to a ground structure for a vehicle. More particularly, to a ground structure for grounding an engine to a vehicle body.

2. Description of Background Art

A vehicle is known wherein a ground for an engine is connected to a vehicle body while a ground for a battery is also connected to the vehicle body, for example, as disclosed in the Official Gazette of Japanese Patent Laid-open No. Hei 8-268176.

A comparatively thin cable is used as the ground cable between the engine and the vehicle body described above. When the engine is carried on the vehicle body, a floating structure is sometimes used wherein a rubber buffer material is interposed between the engine and the vehicle body in order to reduce vibrations of the engine to be transmitted to the vehicle body. The vehicle body ground cable of the engine mounted in such a floating structure as just described preferably has strength against the vibrations of the engine. Further, it is also demanded for the ground cable to have some thickness because the ground cable is stored in a state wherein the ground cable remains attached at an end thereof to the engine or from the operability when the engine is mounted onto the vehicle body. Also it is sometimes demanded to use a plurality of ground cables of a common size to increase the flexibility.

SUMMARY AND OBJECTS OF THE INVENTION

Taking the foregoing demands into consideration, it is an object of the present invention to provide a ground structure for a vehicle that includes improvements in selection of an appropriate vehicle body ground cable.

In order to attain the object described above, according to the present invention, a ground structure is provided for a vehicle wherein an engine and a vehicle body are connected to each other by a cable to ground the engine wherein the cable has a wire diameter set substantially equal to one of the other cables wired to the engine and a part coupled to the engine, which cable has the greatest wire diameter.

With the first characteristic, the cable is formed with an increased thickness and has a wire diameter substantially equal to the one of the other cables. Therefore, the ground structure for a vehicle is advantageous also where the engine is mounted in a floating structure on the vehicle body, and this increases the degree of freedom in designing. In addition, the ground structure for a vehicle is easy in handling when the engine is installed into the vehicle body or when the cable is stored while it remains secured to the engine, and also the universality in use is improved.

According to the present invention, the ground structure for a vehicle has a second characteristic in that the other cables are used to connect a battery to the engine and to the part coupled to the engine.

According to the present invention, the ground structure for a vehicle has a third characteristic in that the other cables include a cable for connecting the battery and a starter motor for the engine to each other.

With the second and third characteristics, the cable of a comparatively great wire diameter used between the battery and the engine or the starter motor and the cable between the engine and the vehicle body are designed with the same specification (wire diameter). Therefore, the number of types of wire diameters of cables to be used in the overall vehicle need not be increased. Accordingly, the cost decreases and the convenience in management increases.

Further, according to the present invention, the ground structure for a vehicle has a fourth characteristic in that the ground structure further includes first coupling means for coupling a cable that connects a negative terminal of a battery and the engine to each other to the engine, and second coupling means for coupling a cable that connects the vehicle body and the engine to each other to the engine wherein the first coupling means and the second coupling means are removably mounted independently of each other on the engine.

With the fourth characteristic, the different cables can be removably connected to the engine individually by the first coupling means and the second coupling means. Therefore, the coupling order of each of the cables can be determined arbitrarily in accordance with an assembly procedure, and assembly of the wiring lines is very much facilitated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 4 is a view showing an example of the sectional area of a cable corresponding to the battery capacity.

DETAILED DESCRIPTION OF THE PREFERRED EMBODIMENTS

Figure 1:
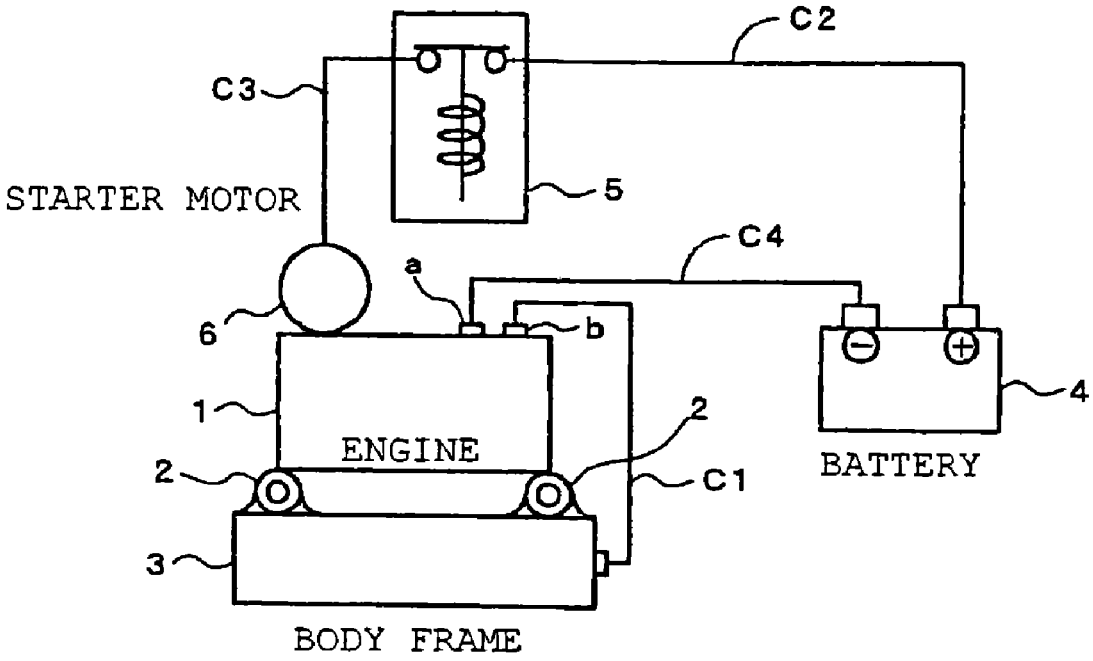
FIG. 1 is a block diagram of the essential parts of a motorcycle having a ground structure according to an embodiment of the present invention.

In the following, an embodiment of the present invention is described with reference to the drawings. FIG. 1 is a wiring diagram of the essential parts showing a ground structure for a motorcycle according to an embodiment of the present invention. Referring to FIG. 1, an engine 1 is connected to a body frame 3 with a plurality of rubber mount bushings (tubular members of rubber) 2 interposed therebetween. The rubber mount bushings 2 have a vibration reducing function for reducing the vibrations of the engine 1 transmitted to the vehicle body. In addition, the engine 1 is electrically isolated from the vehicle body by the rubber mount bushings 2. Accordingly, a body ground cable C1 is wired between the body frame 3 and the engine 1 to ground the engine 1 to the vehicle body. Naturally, it is a matter of course that the engine may otherwise be secured rigidly to the vehicle body.

The positive terminal of a battery 4 is connected to a contact of a starter relay switch 5 by a cable C2. The other contact of the starter relay switch 5 is connected to a starter motor 6 by another cable C3. The negative terminal of the battery 4 is connected to the engine 1 by a feedback ground cable C4. Preferably, ground cables for all electric parts (including sensors and switches) are integrated in the feedback ground cable C4.

The body ground cable C1 of the engine 1 has a diameter substantially equal to one of the other cables wired to the engine 1 (including a part coupled to the engine), that is, the cables C2 (wired to the engine through the starter relay switch), C3, and C4, which has the greatest diameter. As an example, the wire diameter or sectional area of the cables C2 and C3 between the battery 4 and the starter motor 6 is set as the greatest. This is because a high electric current is supplied to the starter motor 6. Where the cable C1 has the greatest thickness in this manner, it is advantageous against vibrations of the engine 1 and facilitates handling thereof when the engine 1 is installed into the vehicle body. Further, where the cable C1 has a wire diameter or sectional area equal to one of the cables C2 to C4, universal use of the parts can be achieved.

Connecting elements a and b (coupling means by a bolt or the like) of the cables C1 and C4 to the engine 1 should be independent of each other. In particular, when the cables C1 and C4 are fastened to the engine 1 using a bolt, not a single bolt is used for the fastening, but different bolts are used to secure them to different positions on the engine 1. Since the order in attaching the cables C1 and C4 to the engine 1 can be set arbitrarily, flexibility is provided to the wiring procedure and the operability is improved. More particularly, the connection of the cables C1 and C4 is hereinafter described.

Figure 2:
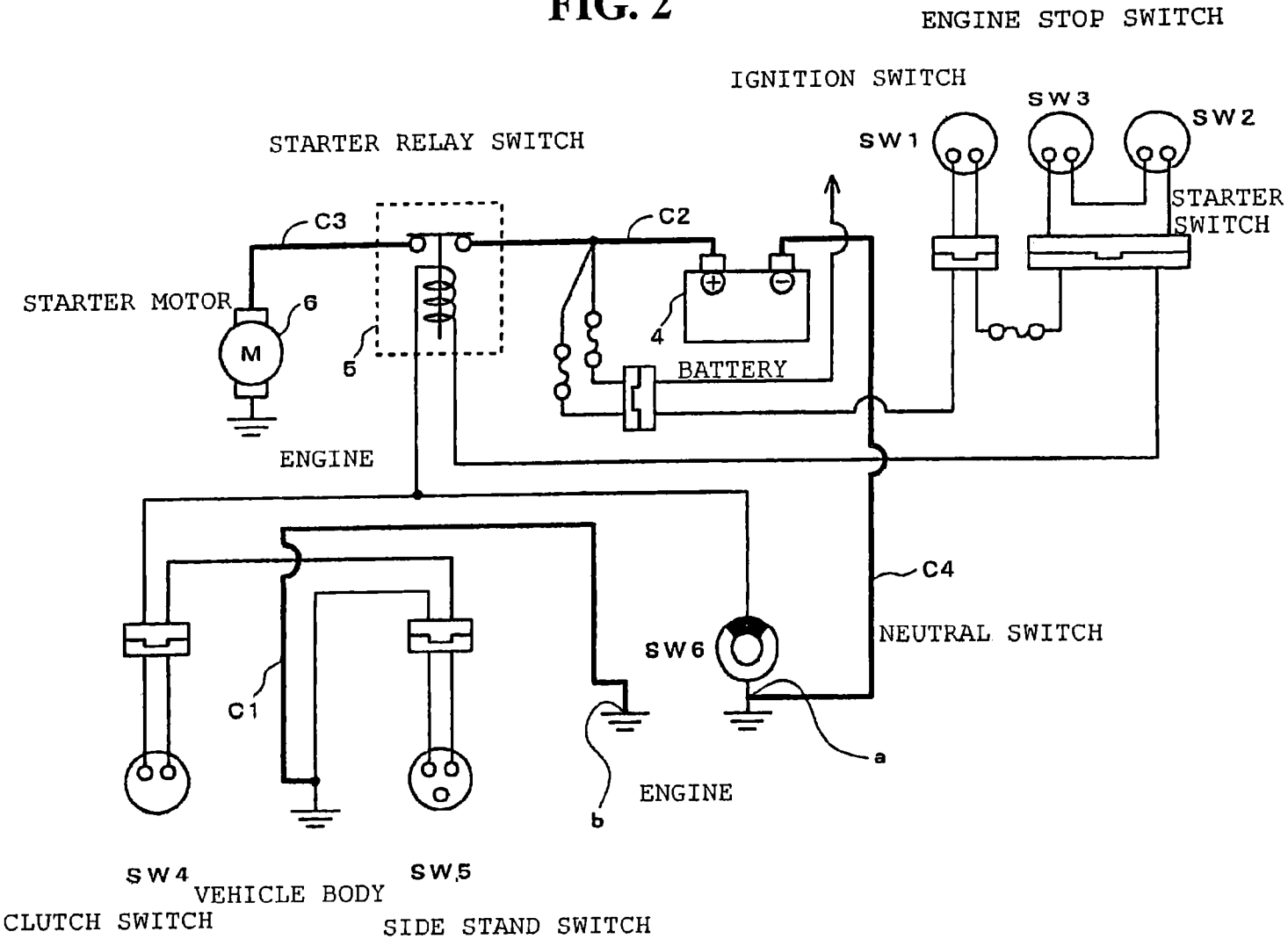
FIG. 2 is a diagram of an electric wiring system for driving a starter motor of the motorcycle.

FIG. 2 is a diagram showing an electric wiring system for driving the starter motor of the motorcycle including the cables C1 to C4. In FIG. 2, the same reference characters as those in FIG. 1 denote like or equivalent elements. A circuit for supplying electric current from the battery 4 to the starter relay switch 5 includes not only an ignition switch SW1, a starter switch SW2, and an engine stop switch SW3, but also a clutch switch SW4, a side stand switch SW5, and a neutral switch SW6 interposed therein. Accordingly, even if the ignition switch SW1 is operated to activate the starter switch SW2, the starter motor 6 of the engine 1 is not energized if the transmission is not in a neutral position, if a side stand is not in an upwardly kicked state, or if a clutch is not in a disconnected state.

Figure 3:
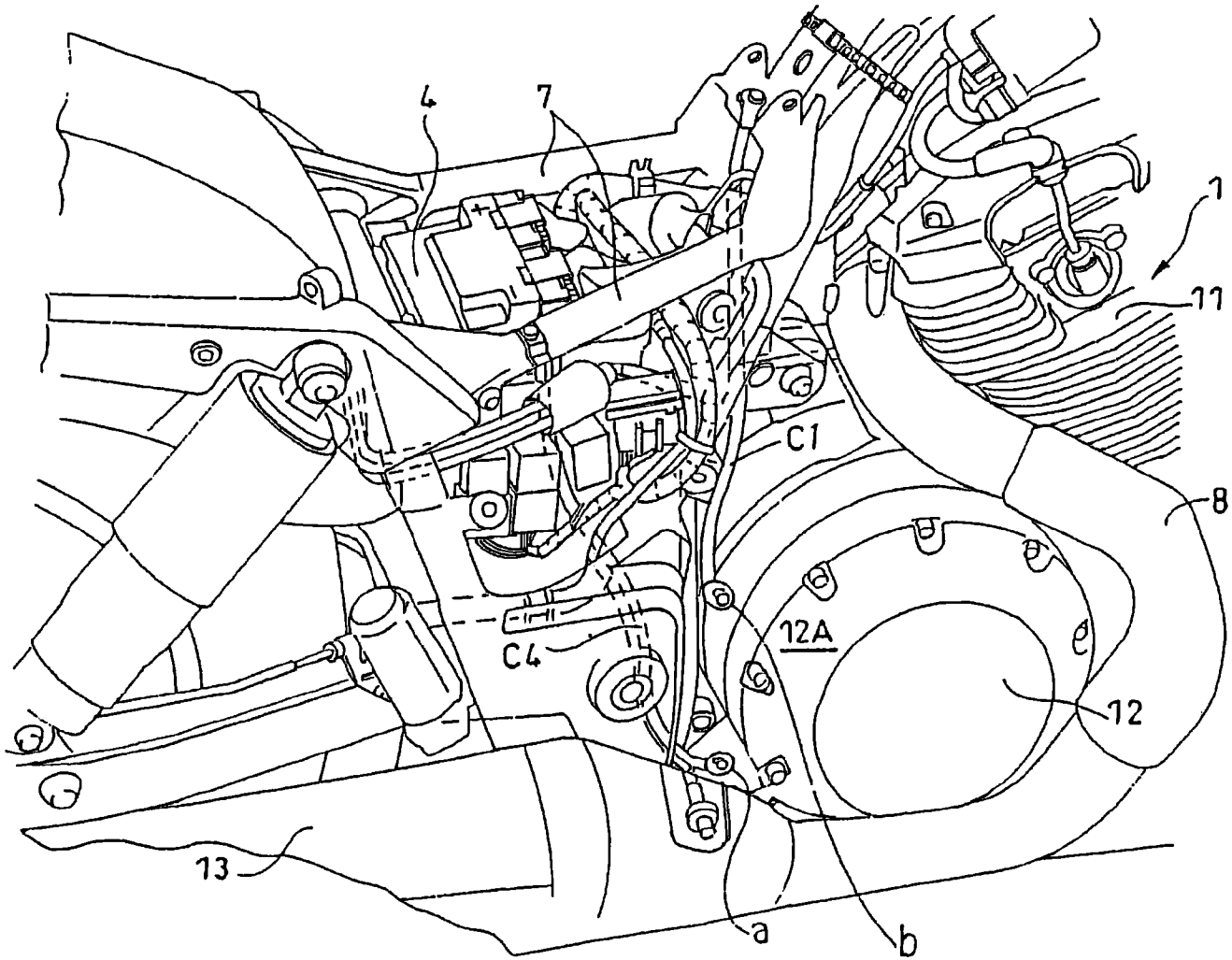
FIG. 3 is a perspective view of essential part of the motorcycle showing an example of wiring scheme of a ground cable.

FIG. 3 is a perspective view of the essential parts of the motorcycle showing an example of a wiring scheme of the ground cable. In FIG. 3, in order to facilitate the understanding of the wiring scheme of the cable, a seat and a fuel tank are not illustrated in the drawing. The engine 1 is accommodated between an upper body frame 7 extending forwardly and rearwardly of the vehicle body and a lower body frame (not shown). The engine 1 includes an engine body 11 with a clutch 12 and the starter motor 6 (refer to FIG. 1 and so forth) assembled to the engine body 11. An exhaust pipe 8, connected to an upper portion of the engine body 11, extends rearwardly of the vehicle body on the lower side of the clutch 12 and is connected to a muffler 13. The upper body frame 7 is bifurcated leftwardly and rightwardly of the vehicle body and extends rearwardly of the vehicle body. The battery 4 is accommodated between the upper body frame 7 bifurcated leftwardly and rightwardly and an engine case 12A.

A terminal of the ground cable C4 is coupled to the negative terminal of the battery 4 while the other terminal of the ground cable C4 is coupled to the engine case 12A that mounts the starter motor 6. A terminal of the ground cable C1 is coupled to the upper body frame 7 while the other terminal is coupled to the engine case 12A similarly to the cable C4. The engine case 12A is formed from an aluminum alloy. While the cables C1 and C4 are coupled to the engine case 12A that is part of the engine 1, they are secured to the engine case 12A separately from each other by bolts (first and second coupling means) separate from each other as shown in FIG. 3.

FIG. 4 is a view showing an example of sectional areas of the cables C2 and C3 suitable for use to supply electric current from the battery 4 to the starter motor 6. As the vehicle size increases and the starter motor size increases, a battery of a greater capacity is required. Thus, the necessary sectional area of the cable is increased. FIG. 4 shows the sectional area (AV mm2) of the cable for each battery capacity (Ah). The sectional areas of the cables C2 and C3 where the supply current to the starter motor 6 is taken into consideration, and the sectional areas of the cables C1 and C4 are set equal to that of the cables C2 and C3.

As is apparent from the foregoing description, according to the present invention, the cable that connects the engine and the vehicle body to each other has a wire diameter set substantially equal to one of the other used cables, which has the greatest wire diameter. Therefore, the ground structure for a vehicle is further advantageous against vibrations of the engine, and is easy in handling when the ground cable is stored while it remains coupled to the engine or when the ground cable is installed into the vehicle body.

More particularly, according to the present invention, since a common part can be used for the different cables, the universality in use of the cables is enhanced and an improvement in efficiency in management and manufacture is achieved.

Further, according to the present invention, the different cables can be coupled by the two coupling means independent of each other. Therefore, the coupling order can be determined arbitrarily in accordance with an assembly procedure, and this can contribute to an improvement in working efficiency.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A ground structure for a vehicle wherein an engine and a vehicle body are connected to each other, comprising:

a first cable extending from a body frame of the vehicle body to the engine for grounding said engine;

a plurality of other cables, including a second cable which directly connects a battery to the engine, a negative terminal of the battery being grounded solely by being directly connected to the engine, the engine being grounded to the body frame by the first cable;

wherein said first cable has a wire diameter set substantially equal to any of the plurality of other cables wired to said engine and any of the plurality of cables wired to a part coupled to said engine, and wherein none of the plurality of other cables has a wire diameter larger than the wire diameter of the first cable.

2. The ground structure for a vehicle according to claim 1, further comprising a third cable of the plurality of other cables used to connect the battery to a part coupled to said engine.

3. The ground structure for a vehicle according to claim 1, further comprising a fourth cable of the plurality of cables for connecting said battery and a starter motor for said engine to each other.

4. The ground structure for a vehicle according to claim 1, wherein said ground structure further comprises:

first coupling means mounted on said engine for coupling the one of the plurality of cables that connects the negative terminal of the battery and said engine to each other; and second coupling means mounted on said engine for coupling the first cable that connects said body frame and said engine to each other;

wherein said first coupling means and said second coupling means are removably mounted independently of each other on said engine.

5. The ground structure for a vehicle according to claim 1, wherein with a battery capacity of approximately 7 Ah, the first cable has a sectional area of approximately 5 Av $mm^2$.

6. The ground structure for a vehicle according to claim 1, wherein with a battery capacity of approximately 9 Ah, the first cable has a sectional area of approximately 8 Av $mm^2$.

7. The ground structure for a vehicle according to claim 1, wherein with a battery capacity of approximately 12 Ah, the first cable has a sectional area in the range of approximately 9–15 Av $mm^2$.

8. The ground structure for a vehicle according to claim 1, wherein with a battery capacity of greater than 14 Ah , the first cable has a sectional area of approximately 15 Av $mm^2$.

9. A ground structure for a vehicle comprising:

a first cable adapted for grounding an engine and an upper body frame to each other, the first cable extending from a body frame to the engine;

a second cable adapted for grounding a battery and the engine to each other, a negative terminal of the battery being grounded by being only connected to the engine, the engine being grounded to the upper body frame by the first cable;

a third cable adapted for wiring an electrical component to the battery; and a fourth cable for connecting the battery and starter motor for said engine to each other, said first and second cables having a wire diameter set substantially equal to the wire diameter of the third cable.

10. The ground structure for a vehicle according to claim 9, wherein said ground structure further comprises:

first coupling means for connecting the first cable to the upper body frame and said engine; and a second coupling means for connecting the second cable to the negative terminal of the battery and said engine;

wherein said first coupling means and said second coupling means are removably mounted independently of each other on said engine.

11. The ground structure for a vehicle according to claim 9, wherein with a battery capacity of approximately 4 Ah, the first cable has a sectional area of approximately 3 Av $mm^2$.

12. The ground structure for a vehicle according to claim 9, wherein with a battery capacity of approximately 7 Ah, the first cable has a sectional area of approximately 5 Av $mm^2$.

13. The ground structure for a vehicle according to claim 9, wherein with a battery capacity of approximately 9 Ah, the first cable has a sectional area of approximately 8 Av $mm^2$.

14. The ground structure for a vehicle according to claim 9, wherein with a battery capacity of approximately 12 Ah, the first cable has a sectional area in the range of approximately 9–15 Av $mm^2$.

15. The ground structure for a vehicle according to claim 9, wherein with a battery capacity of greater than 14 Ah, the cable has a sectional area of approximately 15 Av $mm^2$.

16. The ground structure for a vehicle according to claim 1, wherein grounding of the battery and any other electric parts is integrated into the one of the other cables that connects the battery to the engine.

17. The ground structure for a vehicle according to claim 9, wherein said ground structure further comprises:

two connecting elements formed on said engine, wherein each of the first cable and the second cable is arbitrarily connected to a separate one of the two connecting elements.

18. The ground structure for a vehicle according to claim 9, wherein grounding of the battery and any other electric parts is integrated into the second cable that connects the battery to the engine.

19. A ground structure for a vehicle wherein an engine and a vehicle body are connected to each other, comprising:

a first cable extending from a body frame of the vehicle body to the engine for grounding said engine;

a plurality of other cables, including a second cable which connects a battery to the engine, a negative terminal of the battery being grounded by being only connected to the engine, the engine being grounded to the body frame by the first cable;

wherein said first cable has a wire diameter set substantially equal to any of the plurality of other cables wired to said engine and any of the plurality of cables wired to a part coupled to said engine, wherein none of the plurality of other cables has a wire diameter larger than the wire diameter of the first cable, and wherein with a battery capacity of approximately 4 Ah, the first cable has a sectional area of approximately 3 Av $mm^2$.

* * * * *